United States Patent [19]

Golovko

[11] 4,137,056

[45] Jan. 30, 1979

[54] PROCESS FOR LOW-TEMPERATURE SEPARATION OF AIR

[76] Inventor: Georgy A. Golovko, bulvar A. Tolstogo, 16, kv. 29, Pushkin, Leningrad, U.S.S.R.

[21] Appl. No.: 776,515

[22] Filed: Mar. 2, 1977

Related U.S. Application Data

[63] Continuation of Ser. No. 568,856, Apr. 17, 1975, abandoned.

[30] Foreign Application Priority Data

Apr. 26, 1974 [SU] U.S.S.R. ..... 2015808

[51] Int. Cl.[2] ..... F25J 3/02; F25J 3/03; F25J 3/08

[52] U.S. Cl. ..... 62/13; 62/24; 62/32; 62/29

[58] Field of Search ..... 62/22, 24, 29, 32, 18, 62/13

[56] References Cited

U.S. PATENT DOCUMENTS

| | | | |
|---|---|---|---|
| 1,880,981 | 10/1932 | Pollitzer et al. | 62/22 |
| 2,779,174 | 1/1957 | Vesque | 62/22 |
| 3,079,759 | 3/1963 | Schilling | 62/22 |
| 3,751,933 | 8/1973 | Balabaev et al. | 62/22 |

*Primary Examiner*—Stephen J. Emery
*Attorney, Agent, or Firm*—Steinberg & Blake

[57] ABSTRACT

A process for low-temperature separation of air, wherein liquefied nitrogen and liquefied air enriched with oxygen obtained from preliminary rectification are subjected to secondary rectification to produce gaseous nitrogen containing less than 0.3 vol.% of oxygen and argon impurities, gaseous oxygen-argon mixture and liquefied oxygen-argon mixture containing up to 4.5 vol.% of argon. Subsequently, the gaseous oxygen-argon mixture is subjected to further rectification to produce argon-oxygen mixture containing argon with impurities of 3–0.1 vol.% of oxygen and less than 0.1 vol.% of nitrogen, as well as oxygen with a concentration of from 99.7 to 99.99 vol.%.

1 Claim, 1 Drawing Figure

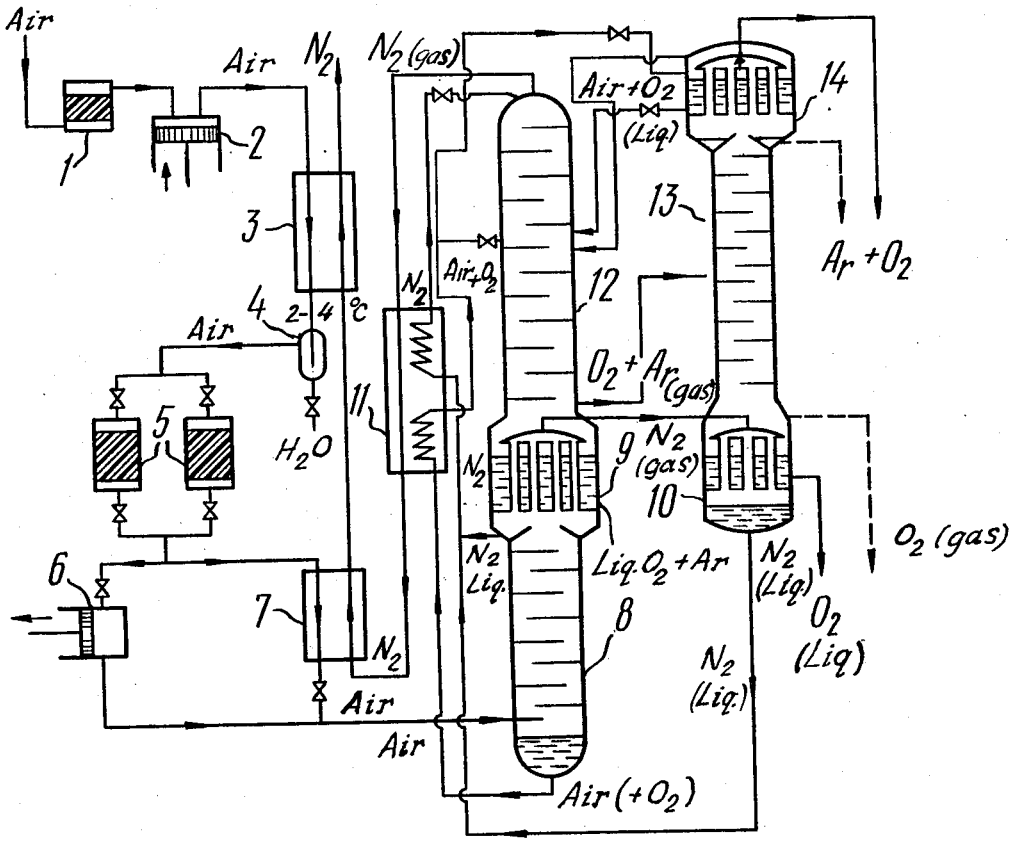
Air
Air
$N_2$
$N_2$ (gas)
Air+$O_2$
(Liq)
14
1
2
3
13
Ar+$O_2$
Air+$O_2$
12
4
2-4
°C
Air
$N_2$
$O_2$+Ar (gas)
11
5
$H_2O$
9
$N_2$ (gas)
10
$N_2$
$N_2$ Liq.
Liq. $O_2$+Ar
$N_2$ (Liq)
$O_2$ (gas)
6
7
8
$O_2$ (Liq)
$N_2$
Air
$N_2$ (Liq)
Air
Air (+$O_2$)

PROCESS FOR LOW-TEMPERATURE SEPARATION OF AIR

This is a continuation of application Ser. No. 568,856 filed Apr. 17, 1975, now abandoned.

The present invention relates to the cryogenic technology, and in particular, to a process for low-temperature separation of air.

These processes are widely used in the chemical and metallurgical industries, in mechanical engineering and in various other industries consuming enormous quantities of nitrogen, oxygen and argon; in the ammonia synthesis, for intensification of production processes (e.g. the use of oxygen in the steel production or in non-ferrous metallurgy), and as protective media (e.g. the use of argon in machining, welding and cutting metals).

It is common knowledge to separate air at low temperatures to obtain oxygen, nitrogen and green argon.

Preliminarily dedusted air is compressed in the range from 6 to 200 kg/cm$^2$, dried, purified from carbon dioxide, acetylene and other impurities and cooled, the air being partially condensed. Cooled and partially condensed air is subjected to preliminary rectification, whereby nitrogen is produced containing less than 2 vol.% of oxygen and argon, as well as liquefied air enriched with oxygen containing 32–40 vol.% of $O_2$, 1.3–1.6 vol.% of Ar and 58.4–66.7 vol.% of nitrogen.

Liquefied air and nitrogen obtained as a result of preliminary rectification are supercooled and subjected to secondary rectification to produce nitrogen containing 1–1.8 vol.% of oxygen and argon, oxygen with a concentration of 99–99.5vol.% and argon fraction containing 6–11 vol.% of Ar, 0.3–1.5 vol.% of $N_2$, oxygen — the balance with a ratio of concentrated argon fraction to nitrogen below 35. The resulting argon fraction is further rectified to produce green argon containing 1–5 vol.% of $O_2$ and 3–15 vol.% of $N_2$. Nitrogen with the impurity of 1–1.8 vol.% of oxygen and argon is usually discharged into the atmosphere, and oxygen with a concentration of 95–99.5 vol.% is used as final product, e.g. as intensifier in metallurgical and chemical processes, in cutting metals and the like. Green argon is used to obtain pure argon. For that purpose, green argon is purified from nitrogen and oxygen. Oxygen is purified by the method of catalytic hydration, wherein oxygen is bound with hydrogen with the formation of water in the presence of a catalyst at 100°–450° C. The reaction of water formation is conducted with an excessive quantity of hydrogen which contaminates argon. As a result of purification from oxygen, a highly humidified mixture of argon, nitrogen and hydrogen is contained which is subjected to compression, drying and rectification. As a result of this treatment, nitrogen and hydrogen are removed, and pure argon is obtained which is used as protective medium, e.g. in argon welding and cutting of metals.

The prior art process provides for obtaining nitrogen of a low concentration, that is containing argon and oxygen impurities in an amount of 1–1.8% so that the ratio of argon extraction is low. This grade of nitrogen cannot be used in industry; thus it cannot be employed as inert gas for blasting electric motors during the drying thereof. Liquefied nitrogen with this content of impurities also cannot be used in mechanical engineering since, when employed to provide for push fit of parts, concentration of oxygen in liquefied nitrogen increases which is a fire hazard.

Oxygen with a concentration of 95–99.5 vol.% obtained by the above-described method contains substantially only argon as impurity which also materially reduces the ratio of argon extraction. In addition, the efficiency of using oxygen as intensifier, e.g. in metallurgical processes of producing steel and non-ferrous metals and in chemical processes in the ammonia production, decreases. The employment of oxygen in mechanical engineering, for instance in the argon welding and cutting of metals impairs the quality of weld and cut. The presence of nitrogen in the argon fraction lowers its temperature thereby impairing the conditions for condensation and rectification so that green argon obtained by the above-described method contains a considerable quantity of impurities: 1–5 vol.% of oxygen and, especially, nitrogen (3–15 vol.%). About 20% of argon is lost during the purification of green argon from these impurities.

The presence of oxygen and nitrogen impurities in green argon results in the necessity of multistage purification which makes the process very complicated and results in higher production cost of argon.

New advanced adsorption method of purification of argon from oxygen can be used only after still another rectification for eliminating nitrogen. The existing method of purifying green argon does not provide for lowering the oxygen content in pure argon below 0.001 vol.% and, besides, it results in contamination of argon with hydrogen due to dissolution of the latter in liquefied argon, whereby such grade of argon cannot be used in many industries as protective medium, e.g. in storing and treating alkali metals, in processing titanium and other rare metals, as well as in welding critical parts in the aerospace industry and in shipbuilding.

In the prior art method, argon fraction is obtained in a low-pressure rectification column (at 1.3–1.7 kg/cm$^2$). Separating this fraction for obtaining green argon containing 1–5 vol.% of oxygen and 3–15 vol.% of nitrogen is, however, associated with large technological difficulties arising from the necessity of maintaining a predetermined concentration of the resulting oxygen and nitrogen, exact level of liquefied oxygen in a condenser, and besides, exact location of the point of admittance of liquefied air enriched with oxygen to the low-pressure column and point of removal of argon fraction from the column. Argon fraction should be removed at an exactly defined point from the low-pressure column. This point is determined by calculations and then specified more accurately during the operation for each given low-pressure column.

The attempts to obtain argon fraction containing no nitrogen by the method of low-temperature separation of air have resulted in a new process.

This process comprises compressing air preliminarily cleaned from dust at 180–200 kg/cm$^2$, purified from carbon dioxide, dried and cooled, the air being partially condensed. Cooled and partially condensed air is subjected to preliminary rectification to produce liquefied nitrogen containing less than 2 vol.% of oxygen and argon, as well as liquefied air enriched with oxygen containing up to 36 vol.% of $O_2$, 1.6 vol.% of Ar and 62.4 vol.% of $N_2$. The liquefied air enriched with oxygen and liquefied nitrogen obtained after the preliminary rectification are subjected to secondary rectification to produce gaseous nitrogen containing less than 1.5 vol.% of oxygen and argon impurities, a gaseous mixture of oxygen and argon and liquefied oxygen-argon mixture containing up to 4.5 vol.% of argon and less than 0.01 vol.% of $N_2$ (ratio of concentration of argon to nitrogen being greater than 500).

The resulting liquefied oxygen-argon mixture is further subjected to rectification to produce argon containing 0.1–0.3 vol.% of oxygen and nitrogen as impurity and oxygen with a concentration of 99.7–99.9 vol.% which is used as final product, e.g. for argon welding.

High concentration of the resulting oxygen reduces argon losses, that is the ratio of argon extraction from air is improved. However, argon obtained by this method contains a considerable amount of impurities so that it cannot be employed as protective medium, e.g. in argon welding and cutting of metals, in the manufacture of electric lamps, in processing titanium and other rare and alkali metals and the like.

For rectification of liquefied oxygen-argon mixture, this method implies the removal of this mixture from a low-pressure rectification column for feeding into another column which is not in communication with the low-pressure column. Feeding liquefied oxygen-argon mixture from a low-pressure rectification column into another column and rectifying this mixture containing below 4.5 vol.% of Ar is associated with high losses of cold which can be compensated for by using an auxiliary cooling circuit thus resulting in higher power consumption and production cost of argon. For the above reasons, this process could not find any commercial application.

It is an object of the invention to improve the ratio of argon extraction.

Another object of the invention is to simplify the process, reduce power consumption and lower the production cost of argon by eliminating the auxiliary cooling circuit in processing oxygen-argon mixture.

Still another object of the invention is to obtain argon-oxygen mixture containing less than 0.1 vol.% of nitrogen.

With these and other objects in view, the invention consists in the provision of a process for low-temperature separation of air comprising the steps of cleaning air from dust, compressing to 180–200 kg/cm$^2$, purifying the compressed air from carbon dioxide and acetylene, dried at a dew point at −60 to −70° C. and cooled at a temperature below the saturation temperature, the air being partially condensed, subjecting the cooled and partially condensed air to preliminary rectification to produce liquefied nitrogen and liquefied air enriched with oxygen with subsequent supercooling of liquefied nitrogen and liquefied air enriched with oxygen and secondary rectification thereof to produce gaseous nitrogen, gaseous oxygen-argon mixture and liquefied oxygen-argon mixture containing up to 4.5 vol.% of argon, wherein, according to the invention, the secondary rectification is conducted with the use of liquefied nitrogen obtained after the preliminary rectification, and gaseous nitrogen is obtained which contains less than 0.3 vol.% of oxygen and argon impurities, and the gaseous oxygen-argon mixture obtained as a result of the secondary rectification is subjected to further rectification to produce argon-oxygen mixture containing argon with the impurities of 3–0.1 vol.% of oxygen and less than 0.1 vol.% of nitrogen, as well as oxygen with a concentration of 99.7–99.99 vol.%.

Obtaining gaseous nitrogen containing less than 0.3 vol.% of oxygen and argon impurities prevents considerable losses of argon with nitrogen and improves the ratio of argon extraction from air. Nitrogen containing less than 0.3 vol.% of impurities can be successfully used in blasting electric motors during the drying thereof. Liquefied nitrogen containing such minor amount of impurities may be widely used in providing push fit of various parts since concentration of oxygen will grow slowly during evaporation of nitrogen without ever attaining the fire hazard level.

Producing commercially utilizable oxygen as a result of further rectification of the oxygen-argon mixture of the above-defined composition with a concentration of oxygen of 99.5–99.99 vol.% also materially reduces argon losses, that is the ratio of extraction thereof is improved. The employment of oxygen having such high concentration provides for considerable improvement of productivity and quality of argon welding and cutting of metals, better efficiency of oxygen as intensifier, e.g. in the steel and non-ferrous metals production, as well as in chemical processes, e.g. in the synthesis of ammonia. Argon extraction ratio from air is from 0.85 to 0.95 in the process of low-temperature separation according to the invention.

In producing oxygen of the above-defined composition in the gaseous form, air pressure after a compressor may be substantially reduced.

Separating gaseous oxygen-argon mixture containing 7–10 vol.% of argon and less than 0.01 vol.% of $N_2$ (with argon to nitrogen concentration ratio above 1000) in a rectification column communicating with a low-pressure rectification column of the main plant does not require the use of an auxiliary cooling circuit to compensate for cold losses so that the process is considerably simplified and power consumption is reduced.

Low relative content of nitrogen in the processed gaseous oxygen-argon mixture increases the temperature thereof, thereby improving the conditions for condensation of oxygen and rectification of the mixture. Removing gaseous oxygen-argon mixture containing 7–10 vol.% of argon and less than 0.01. vol.% of nitrogen is not associated with any technological difficulties thus, it is not required to maintain an exact predetermined concentration of nitrogen, exact level of liquefied oxygen in the condenser, determination of exact location of the point of admittance of liquefied air enriched with oxygen to the low-pressure rectification column and point of removal of argon fraction which now may be located directly above the intertube space of the condenser. Finally, obtaining, after further rectification, argon-oxygen mixture containing 3–0.1 vol.% of oxygen and less than 0.1 vol.% of nitrogen provides for material simplification of the production method when subsequently processing this mixture to obtain pure argon. The argon-oxygen mixture of the above defined composition may be subjected to adsorption purification from oxygen, and partially from nitrogen, by passing it through a cooled layer of synthetic zeolites of the NaA(4A) type directly after leaving the rectification column. The use of the adsorption method of purification of argon from oxygen eliminates the employment of the method of catalytic hydration with hydrogen, makes the process of purification explosion-safe and does not result in humidifying the product and contamination thereof with hydrogen; besides, the production cost of argon is lowered, and its quality is improved so that pure dry argon with a concentration better than 99.99 vol.% may be obtained. Pure dry argon of the above-mentioned concentration may be successfully used as protective medium, e.g. in argon welding and cutting of metals, including the welding of critical parts in the aerospace industry, in shipbuilding, in the manufacture of electric lamps, in processing titanium and other rare and alkali metals and the like.

Other objects and advantages of the invention will become apparent from the following examples of specific embodiments thereof when read in conjunction with the accompanying drawing diagrammatically showing an apparatus for carrying out the process for low-temperature separation of air according to the invention.

The process for low-temperature separation of air according to the invention comprises the following.

Air cleaned from dust is compressed at 180–200 kg/cm$^2$, purified from carbon dioxide, acetylene and other impurities, dried at a dew point of −60 to −70° C. and cooled at a temperature below the saturation point, the air being partially condensed. The cooled and partially condensed air is subjected to preliminary rectification to produce liquefied nitrogen containing less than 0.5 vol.% of oxygen and argon, and liquefied air enriched with oxygen and containing 32–36 vol.% of oxygen, 1.5–1.8 vol.% of argon and 60.2–66.5 vol.% of nitrogen. During the preliminary rectification, nitrogen concentration is increased due to either reducing its removal or by a partial recycling thereof. Liquefied air enriched with oxygen and liquefied nitrogen obtained as a result of the preliminary rectification are supercooled and subjected to secondary rectification to produce gaseous nitrogen with a content of oxygen and argon impurities less than 0.3 vol.%, gaseous oxygen-argon mixture containing 7–10 vol.% of argon and liquefied oxygen-argon mixture of the same weight as the latter component containing up to 4.5 vol.% of argon and less than 0.01 vol.% of $N_2$.

Gaseous nitrogen of high concentration containing less than 0.3 vol.% of oxygen and argon impurities is obtained by using secondary rectification of liquefied nitrogen containing less than 0.5 vol.% of oxygen and argon obtained after the preliminary rectification.

This grade of nitrogen is being very widely used in industry, for instance as inert gas in blasting electric motors during the drying thereof or for providing push fit of machine parts.

Lowering the impurities content in gaseous nitrogen improves the ratio of argon extraction from air.

The gaseous oxygen-argon mixture containing 7–10 vol.% of Ar and 0.01–0.0001 vol.% of $N_2$ obtained as a result of secondary rectification is removed to be further rectified. It should be noted that the amount of gas subjected to rectification at this stage is of 21.86–21.9 vol.% of the air being processed and provides for obtaining argon-oxygen mixture containing all argon with the impurities of 3–0.1 vol.% of oxygen and less than 0.1 vol.% of nitrogen, as well as all commercially utilizable oxygen of a high concentration of 99.7–99.99 vol.%. Argon losses with such grade of oxygen are naturally reduced, and the ratio of extraction thereof is improved.

The commercially utilizable oxygen of such concentration may be used in missiles as fuel oxidant, in argon welding and cutting of metals.

Oxygen of high concentration may be obtained either in gaseous or liquid state.

The process for low-temperature separation of air may be carried out in the apparatus described herebelow.

Air passes through a filter 1 to be cleaned from dust and is fed to a compressor 2 to be compressed therein at 180–200 kg/cm$^2$. Then the compressed air passes through a heat exchanger 3 wherein it is cooled at 2–4° C. and is then fed, via a water trap 4 removing moisture drops, to a plant 5 for drying the air and purffying it from carbon dioxide and acetylene. This plant 5 comprises at least two adsorbers filled with synthetic zeolite of the CaA(5A) or NaX(9A) type. At +5–10° C., these zeolites substantially completely dry the air at a dew point of −60–70° C. and purify it from carbon dioxide and acetylene to 1–2 cm$^3$/m$^3$.

After the plant 5 for drying and purification, the compressed air is divided into two substantially equal streams of which one is fed to an expander 6 to be expanded to a pressure of 5–6 kg/cm$^2$, and the other is fed to a heat exchanger 7 to be cooled at a temperature below the saturation point and to be partially condensed. Then both air streams—from the expander 6 and from the heat exchanger 7—are united together to be fed to a medium-pressure rectification column 8 operating e.g. at 6 kg/cm$^2$ for preliminary rectification to produce liquefied nitrogen containing less than 0.5 vol.% of oxygen and argon impurities and liquefied air enriched with oxygen containing 32–36 vol.% of oxygen, 0.3–1.8 vol.% of argon and 60.2–66.7 vol.% of nitrogen. Liquefied nitrogen is used for condensing gaseous nitrogen in the tubes of a condenser 9 due to the boiling of liquefied oxygen-argon mixture in the intertube space. A part of the gaseous nitrogen is removed from the condenser 9 to be fed to a condenser 10 as heating medium. After the condensation in the condenser 10, this nitrogen is added to the main stream of liquefied nitrogen and, together with the liquefied air enriched with oxygen, supercooled in a heat exchanger 11 by using gaseous nitrogen removed from a rectification column 12, and then both are fed to the low-pressure column 12 operating, e.g. at 1.5 kg/cm$^2$ for secondary rectification. As a result of the secondary rectification in the column 12, gaseous nitrogen is obtained containing less than 0.3 vol.% of oxygen and argon impurities, gaseous oxygen-argon mixture containing 7–10 vol.% of argon and less than 0.01 vol.% of nitrogen, and liquefied oxygen-argon mixture containing up to 4–5 vol.% of argon and less than 0.01 vol.% of nitrogen. The gaseous nitrogen of the above-defined concentration is removed at the top portion of the column 12 and discharged therefrom through the heat exchangers 11,7 and 3.

The gaseous oxygen-argon fraction in an amount of 21.8–21.0% of the air being processed is subjected to further rectification in a low-pressure column 13 operating, e.g. at 1.3–1.5 kg/cm$^2$, whereby oxygen is condensed and flows down into the condenser 10, and argon-oxygen mixture containing less than 3–0.1 vol.% of oxygen and less than 0.1 vol.% of nitrogen flows upwards. Liquid required for the conduct of rectification process in the column 13 above the point of admittance of the oxygen-argon mixture to be separated is formed in the tubes of a condenser 14 due to the boiling of a part of the liquefied air enriched with oxygen in the intertube space of the condenser 14. Vapours that are necessary to provide for rectification in the column 13 below the point of admittance of the oxygen-argon mixture to be separated are obtained due to evaporation of argon and oxygen in the intertube space of the condenser 10 due to condensation of nitrogen vapours removed from the condenser 9.

Commercially utilizable oxygen with a concentration of 99.7–99.99 vol.% in liquid or gaseous state is removed from the intertube space of the condenser 10.

The argon-oxygen mixture containing the impurities of 3–0.1 vol.% of oxygen and less than 0.1 vol.% of nitrogen may also be removed in either liquid or gaseous state from the condenser 14 and is fed directly for purification, e.g. by the adsorption method.

EXAMPLE 1

Air was cleaned from dust in the filter 1, compressed in the compressor 2 at 180 kg/cm$^2$ and cooled in the heat exchanger 3 at 2–4° C. Then the compressed air was fed, via the water trap 4 eliminating moisture drops, to the adsorption plant 5, wherein the air was dried at a dew point −60–70° C. and purified from carbon dioxide and acetylene to a total residual content thereof less than 1–2 cm$^3$ per m$^3$ of the air being processed. The compressed air, which was dried and purified from carbon dioxide and acetylene, was divided, after leaving the plant 5, into two streams: 55% were fed to the expander 6 wherein the air was expanded at 6 kg/cm$^2$, and the remaining 45% - to the heat exchanger 7 to be cooled below the saturation point so that the air was partially condensed. Then both air streams were united together to be fed to the column 8 operating at 5–6 kg/cm$^2$. As a result of rectification in the column 8 and condensation in the condensers 9 and 10, liquefied nitrogen was obtained containing 0.3 vol.% of $O_2$ and 0.2 vol.% of Ar, and in the bottom part of the column 8 liquefied air enriched with oxygen was collected which contained 36 vol.% of $O_2$ and 1.3–1.8 vol.% of Ar, the balance being nitrogen.

Then the liquefied air enriched with oxygen and liquefied nitrogen were supercooled by 3–7° C. in the heat exchanger 11 and fed for secondary rectification in the low-pressure column 12 operating at 1.3–1.5 kg/cm$^2$. A part of the supercooled liquefied air enriched with oxygen was used as coolant providing for rectification and compensation for cold losses in the column 13, and for that purpose, about 50% of liquefied air enriched with oxygen were fed into the intertube space of the condenser 14 after leaving the heat exchanger 11.

After evaporating in the condenser 14, this air was fed to the column 12 for rectification.

As a result of secondary rectification in the column 12 gaseous nitrogen was obtained in the top part thereof containing less than 0.3 vol.% of oxygen and argon impurities, and in the bottom part of the column a gaseous oxygen-argon mixture containing 7 vol.% of Ar and 0.0001 vol.% of nitrogen, as well as liquefied oxygen-argon mixture of the same weight as the latter component containing up to 4.5 vol.% of Ar and less than 0.0001 vol.% of nitrogen boiling in the intertube space of the heat exchanger 9 were obtained.

Gaseous nitrogen was removed through the heat exchangers 11,7 and 3 wherein it was heated at a temperature approximating the compressed air temperature at the inlet of the heat exchanger 3.

The gaseous oxygen-argon mixture containing 7 vol.% of Ar and 0.0001 vol.% of nitrogen was fed to the column 13 operating at 1.3–1.5 kg/cm$^2$ for further rectification, whereby argon-oxygen mixture containing 99.9 vol.% of argon, 0.1 vol.% of oxygen and 0.001 vol.% of nitrogen flowed upwards to the top portion of the column 13 in the tubes of the condenser 14, and commercially utilizable oxygen with concentration of 99.7 vol.% was collected in the intertube space of the condenser 10 and removed in the liquid state. Argon extraction ratio was 0.85.

EXAMPLE 2

In the low-temperature separation dedusted air was compressed at 190 kg/cm$^2$, dried and purified from carbon dioxide and acetylene, and subjected to the primary and secondary rectification as described in Example 1, gaseous nitrogen was obtained in the top part of the column 12 containing oxygen and argon impurities of less than 0.3 vol.%, and gaseous oxygen-argon mixture was obtained in the bottom part of the column containing 8 vol.% of Ar and 0.001 vol.% of $N_2$, and liquefied oxygen-argon mixture was obtained in the condenser 9. The gaseous oxygen-argon mixture was subjected to further rectification in the column 13 to produce argon-oxygen mixture containing 99 vol.% of Ar and 0.01 vol.% of $N_2$, as well as oxygen with concentration of 99.85 vol.% removed in liquid state.

Argon extraction ratio was 0.9.

EXAMPLE 3

In the low-temperature separation of air, air was dedusted in the filter 1, compressed in the compressor 2, dried and purified from carbon dioxide and acetylene, and subjected to the primary and secondary rectification as described in Example 1, gaseous nitrogen was obtained in the top portion of the column 12 containing oxygen and argon impurities less than 0.3 vol.%, gaseous oxygen-argon mixture was obtained in the bottom part of the column 12 containing 10 vol.% of Ar, 0.01 vol.% of $N_2$, and liquefied oxygen-argon mixture was obtained in the condenser 9 containing up to 4.5 vol.% of Ar and less than 0.01 vol.% of $N_2$. The gaseous oxygen-argon mixture of the above-defined composition was removed somewhat above the intertube space of the condenser 9 and fed for further rectification in the column 13. As a result of this rectification, argon-oxygen mixture was obtained in the top part of the column 13 containing 97 vol.% of Ar, up to 3 vol.% of $O_2$ and less than 0.1 vol.% of $N_2$, and oxygen with concentration of 99.99 vol.% was obtained in the bottom part of the column. Oxygen was removed in liquid state, and the argon-oxygen mixture was removed in either gaseous or liquid state.

Argon extraction ratio was about 0.95.

The process according to the invention may be advantageously used in plants operating with a low-pressure cycle (6–9 kg/cm$^2$). At present, argon extraction ratio at such plants does not exceed 0.25–0.35, whereas the employment of the process according to the invention may improve the extraction ratio by 2–3 times. It should be noted, that argon, krypton and xenon may be obtained at the same time.

What is claimed is:

1. A process for low temperature separation of air which comprises removing dust from air; compressing the dedusted air to 180–200 kg/cm$^2$; purifying the compressed air by removing carbon dioxide and acetylene therefrom, drying to a due point of −60° C. to −70° C. and cooling at a temperature below the condensation temperature, thus partially condensing the air; subjecting the cooled and partially condensed air to primary rectification in a high pressure column to produce, at the top reflux condenser, liquified nitrogen containing less than 0.5 vol.% of oxygen and argon and at the bottom of the column oxygen-enriched liquified air containing 32–36 vol.% of oxygen, 1.5–1.8 vol.% of argon and 60.2–66.5 vol.% of nitrogen; supercooling said liquified nitrogen and oxygen-enriched air; subjecting the supercooled air enriched with oxygen to secondary rectification by said supercooled liquified nitrogen in a low pressure column, to obtain from the top of said low pressure column gaseous nitrogen containing less than 0.3 vol.% of oxygen and argon impurities, a gaseous oxygen-argon mixture containing 7–10 vol.% of argon and a liquified oxygen-argon mixture containing up to 4.5 vol.% of argon and less than 0.01 vol.% of nitrogen; and subjecting said gaseous oxygen-group mixture to a further rectification in a second low pressure column to produce an argon-oxygen mixture containing argon with impurities of 3–0.1 vol.% of oxygen and less than 0.1 vol.% of nitrogen, as well as oxygen with a concentration of 99.7–99.9 vol.% oxygen.

* * * * *